US008890794B2

(12) United States Patent
Kim et al.

(10) Patent No.: US 8,890,794 B2
(45) Date of Patent: Nov. 18, 2014

(54) METHOD OF COMPENSATING FOR PIXEL DATA AND LIQUID CRYSTAL DISPLAY

(75) Inventors: Dongwoo Kim, Seoul (KR); Heejung Hong, Seoul (KR); Kyungjoon Kwon, Seoul (KR); Heewon Ahn, Gyeonggi-do (KR); Daeho Cho, Seoul (KR)

(73) Assignee: LG Display Co., Ltd., Seoul (KR)

( * ) Notice: Subject to any disclaimer, the term of this patent is extended or adjusted under 35 U.S.C. 154(b) by 951 days.

(21) Appl. No.: 12/843,263

(22) Filed: Jul. 26, 2010

(65) Prior Publication Data

US 2011/0122170 A1 May 26, 2011

(30) Foreign Application Priority Data

Nov. 23, 2009 (KR) ..... 10-2009-0113143

(51) Int. Cl.

| | |
|---|---|
| ***G09G 3/36*** | (2006.01) |
| ***G09G 5/00*** | (2006.01) |
| ***G09G 3/34*** | (2006.01) |

(52) U.S. Cl.

CPC ..... *G09G 3/3406* (2013.01); *G09G 2320/066* (2013.01); *G09G 2320/0646* (2013.01); *G09G 3/3648* (2013.01)

USPC ..... 345/102; 345/690

(58) Field of Classification Search

USPC ..... 345/87–104, 204, 213, 690–699

See application file for complete search history.

(56) References Cited

U.S. PATENT DOCUMENTS

| | | | | |
|---|---|---|---|---|
| 2005/0017990 | A1* | 1/2005 | Yoshida | 345/690 |
| 2006/0284802 | A1* | 12/2006 | Kohno | 345/76 |
| 2009/0189543 | A1 | 7/2009 | Yeo et al. | |

FOREIGN PATENT DOCUMENTS

| | | |
|---|---|---|
| CN | 101572066 A | 11/2009 |
| TW | 200426401 | 12/2004 |

OTHER PUBLICATIONS

Text of the First Office Action dated Sep. 30, 2013, from the Taiwan Patent Office in counterpart Taiwanese application No. 099121905.

* cited by examiner

*Primary Examiner* — Stephen Sherman

(74) *Attorney, Agent, or Firm* — Morgan, Lewis & Bockius LLP

(57) ABSTRACT

A method of compensating for pixel data includes extending a side portion and a corner portion of a real screen to set an virtual screen, setting dimming values of the virtual screen using dimming values of the real screen, calculating an amount of light of each of pixels on the real screen using the dimming values of the virtual screen mapped to a predetermined analysis area, and multiplying the amount of light of each pixel by a gain of each pixel to modulate pixel data.

6 Claims, 10 Drawing Sheets

FIG. 5

Real screen(10x8)

Imaginary screen (14x12)

| | | | | | | | | | | | | | |
|---|---|---|---|---|---|---|---|---|---|---|---|---|---|
| 12 | 11 | 11 | 12 | 13 | 14 | 15 | 16 | 17 | 18 | 19 | 20 | 20 | 19 |
| 2 | 1 | 1 | 2 | 3 | 4 | 5 | 6 | 7 | 8 | 9 | 10 | 10 | 9 |
| 2 | 1 | 1 | 2 | 3 | 4 | 5 | 6 | 7 | 8 | 9 | 10 | 10 | 9 |
| 12 | 11 | 11 | 12 | 13 | 14 | 15 | 16 | 17 | 18 | 19 | 20 | 20 | 19 |
| 22 | 21 | 21 | 22 | 23 | 24 | 25 | 26 | 27 | 28 | 29 | 30 | 30 | 29 |
| 32 | 31 | 31 | 32 | 33 | 34 | 35 | 36 | 37 | 38 | 39 | 40 | 40 | 39 |
| 42 | 41 | 41 | 42 | 43 | 44 | 45 | 46 | 47 | 48 | 49 | 50 | 50 | 49 |
| 52 | 51 | 51 | 52 | 53 | 54 | 55 | 56 | 57 | 58 | 59 | 60 | 60 | 59 |
| 62 | 61 | 61 | 62 | 63 | 64 | 65 | 66 | 67 | 68 | 69 | 70 | 70 | 69 |
| 72 | 71 | 71 | 72 | 73 | 74 | 75 | 76 | 77 | 78 | 79 | 80 | 80 | 79 |
| 72 | 71 | 71 | 72 | 73 | 74 | 75 | 76 | 77 | 78 | 79 | 80 | 80 | 79 |
| 62 | 61 | 61 | 62 | 63 | 64 | 65 | 66 | 67 | 68 | 69 | 70 | 70 | 69 |

Imaginary screen

METHOD OF COMPENSATING FOR PIXEL DATA AND LIQUID CRYSTAL DISPLAY

This application claims the benefit of Korea Patent Application No. 10-2009-0113143 filed on Nov. 23, 2009 the entire contents of which is incorporated herein by reference for all purposes as if fully set forth herein.

BACKGROUND OF THE INVENTION

1. Field of the Invention

Exemplary embodiments of the invention relate to a method of compensating for pixel data and a liquid crystal display using the same.

2. Discussion of the Related Art

A range of application for liquid crystal displays has gradually widened because of its excellent characteristics such as light weight, thin profile, and low power consumption. A backlit liquid crystal display controls an electric field applied to a liquid crystal layer and modulates light coming from a backlight unit, thereby displaying an image.

The image quality of the liquid crystal display depends on contrast characteristics. It is limited to an improvement of the contrast characteristics using only a method for controlling a data voltage applied to a liquid crystal layer of a liquid crystal display panel to modulate a light transmittance of the liquid crystal layer. Accordingly, a backlight dimming method for controlling a luminance of a backlight unit based on an input image is developed so as to improve the contrast characteristics, and thus greatly improves the contrast characteristics. The backlight dimming method adaptively controls the luminance of the backlight unit based on the input image to thereby reduce power consumption. The backlight dimming method includes a global dimming method for controlling a luminance of an entire display surface of the liquid crystal display panel and a local dimming method for locally controlling a luminance of a display surface of the liquid crystal display panel by dividing the display surface into a plurality of blocks.

The global dimming method may improve a dynamic contrast measured between two successively arranged frame periods. The local dimming method locally controls the luminance of the display surface during one frame period, thereby improving a static contrast that is difficult to improve using the global dimming method.

The local dimming method divides the backlight unit into the plurality of blocks to make a backlight luminance of a block corresponding to a bright image high, and to make a backlight luminance of a block corresponding to a relatively dark image low. Because the plurality of blocks each including light sources are individually turned on in the local dimming method, the backlight luminance in the block is less than a backlight luminance measured when all of the light sources of the backlight unit are turned on in a non-local dimming state (i.e., when the local dimming is not applied). Pixel data may be compensated so as to compensate for the low backlight luminance in the local dimming method. Pixel data may be compensated based on the result of an analysis of an amount of light in the turned-on light sources belonging to each block. The analysis of the light amount uses a light profile obtained by numerically expressing an amount of light of each pixel. The light profile is a value obtained by a sum of an amount of light of a specific pixel and an amount of light required to reach from pixels around the specific pixel to the specific pixel and then multiplying the sum by a dimming value of each pixel. The light profile is a value numerically expressing an amount of light of each pixel. However, in a related art method for calculating the light profile, there is a large error in a light amount calculation value of each pixel in a side portion or a corner portion of the liquid crystal display panel, and the large error is reflected on a compensation value of the pixel data.

SUMMARY OF THE INVENTION

Exemplary embodiments of the invention provide a method of compensating for pixel data and a liquid crystal display using the same capable of minimizing of an error in an amount of light of each pixel in a side portion and a corner portion of a liquid crystal display panel when a light profile for pixel data compensation is calculated in local dimming.

In one aspect, there is a method of compensating for pixel data comprising extending a side portion and a corner portion of a real screen to set an virtual screen, setting dimming values of the virtual screen using dimming values of the real screen, calculating an amount of light of each of pixels on the real screen using the dimming values of the virtual screen mapped to a predetermined analysis area, and multiplying the amount of light of each pixel by a gain of each pixel to modulate pixel data.

In another aspect, there is a method of compensating for pixel data comprising calculating an amount of light of each of pixels using dimming values of a predetermined analysis area, setting a first gain value of a side portion and a corner portion of a liquid crystal display panel to be greater than a second gain value of a middle portion of the liquid crystal display panel, and multiplying an amount of light of each of first pixels existing in the side portion and the corner portion of the liquid crystal display panel by the first gain value to modulate data of the first pixels and multiplying an amount of light of each of second pixels existing in the middle portion of the liquid crystal display panel by the second gain value to modulate data of the second pixels.

In another aspect, there is a liquid crystal display comprising a liquid crystal display panel, a backlight unit configured to provide light to the liquid crystal display panel, a light source driver configured to drive light sources of the backlight unit, a local dimming controller configured to divide the liquid crystal display panel into a plurality of blocks, calculate a dimming value of each block, control the light source driver using the dimming value of each block, and modulate pixel data of the liquid crystal display panel.

The local dimming controller extends a side portion and a corner portion of a real screen to set an virtual screen, sets dimming values of the virtual screen using dimming values of the real screen, calculates an amount of light of each of pixels on the real screen using the dimming values of the virtual screen mapped to a predetermined analysis area, and multiplies the amount of light of each pixel by a gain of each pixel to modulate pixel data.

The local dimming controller calculates an amount of light of each of pixels using dimming values of a predetermined analysis area, sets a first gain value of a side portion and a corner portion of a liquid crystal display panel to be greater than a second gain value of a middle portion of the liquid crystal display panel, multiplies an amount of light of each of first pixels existing in the side portion and the corner portion of the liquid crystal display panel by the first gain value to modulate data of the first pixels, and multiplies an amount of light of each of second pixels existing in the middle portion of the liquid crystal display panel by the second gain value to modulate data of the second pixels.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings:

FIG. 5 illustrates an virtual screen applied to a method of compensating for pixel data according to an exemplary embodiment of the invention;

DETAILED DESCRIPTION OF THE EMBODIMENTS

Figure 1:
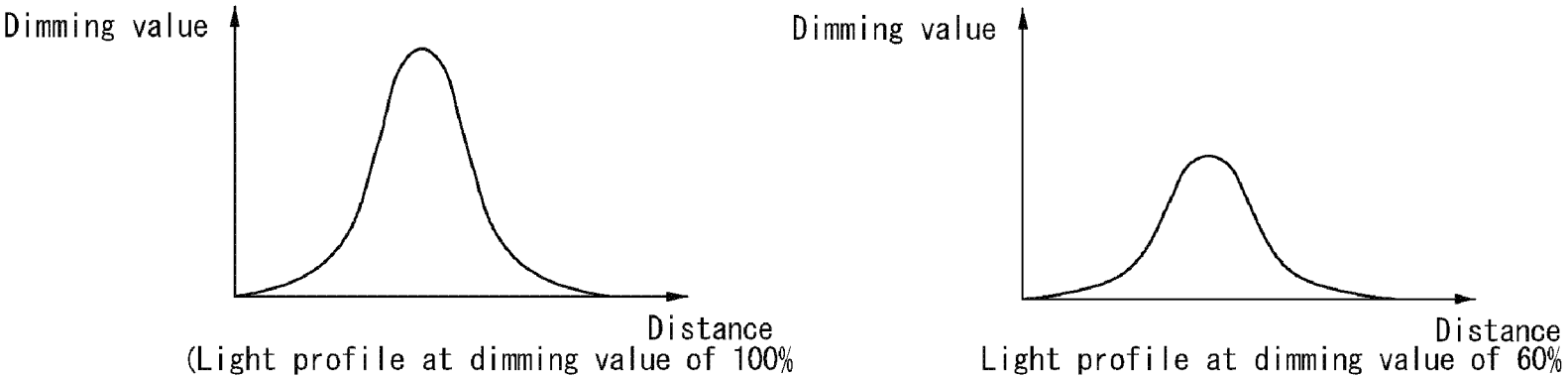
FIG. 1 illustrates a light profile at a dimming value of 100% and a light profile at a dimming value of 60%.

The invention will be described more fully hereinafter with reference to the accompanying drawings, in which example embodiments of the inventions are shown. This invention may, however, be embodied in many different forms and should not be construed as limited to the embodiments set forth herein. Like reference numerals designate like elements throughout the specification. In the following description, if it is decided that the detailed description of known function or configuration related to the invention makes the subject matter of the invention unclear, the detailed description is omitted.

Names of elements used in the following description are selected in consideration of facility of specification preparation. Thus, the names of the elements may be different from names of elements used in a real product.

Before exemplary embodiments of the invention are described, a method for calculating a light profile is described with reference to FIGS. 1 to 4C so as to help an understanding of the exemplary embodiments of the invention.

Figure 2A:
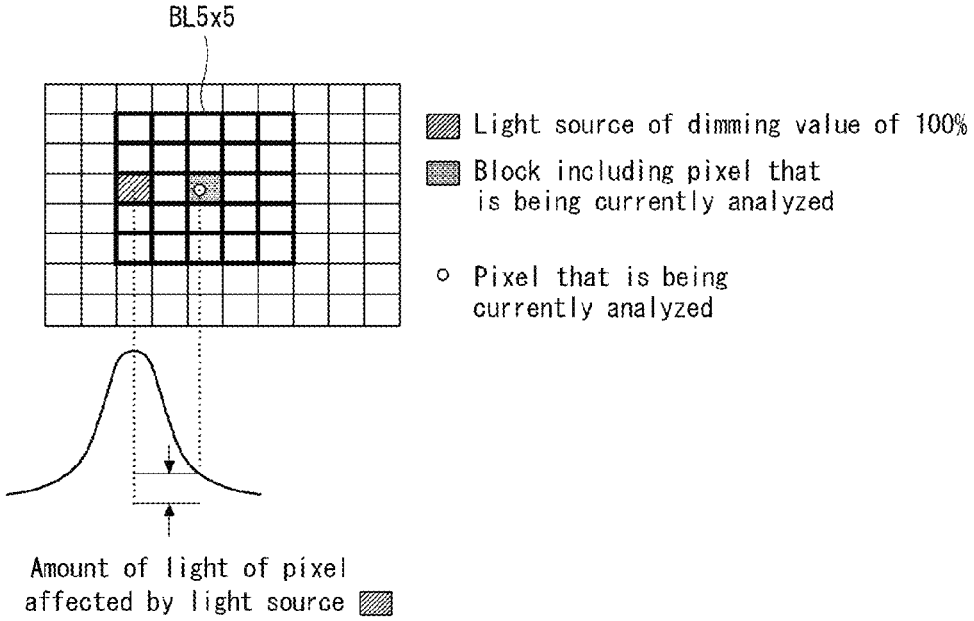
FIG. 2A illustrates a method for calculating a light profile depending on a distance between a light source and a pixel of an analysis area to be analyzed when a dimming value is 100%.
Figure 2B:
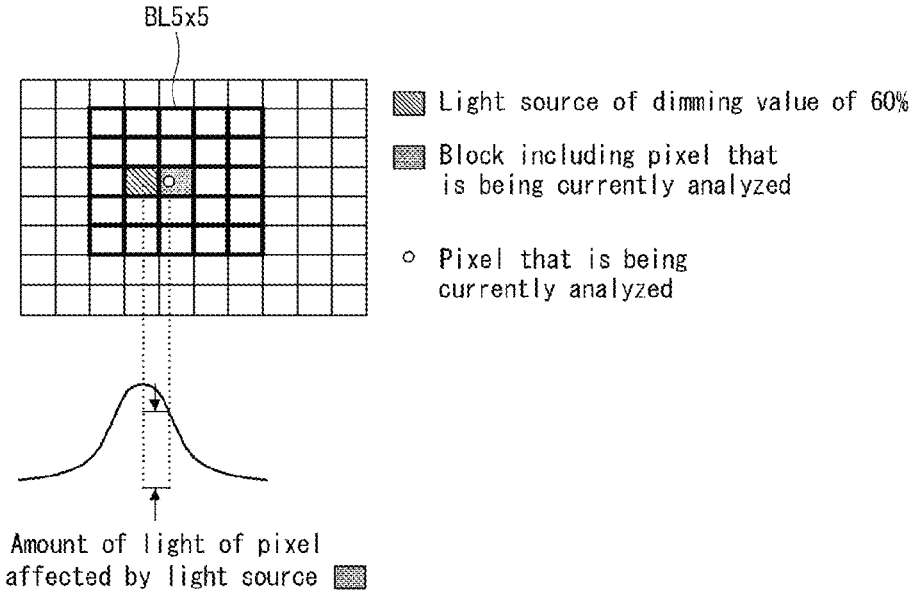
FIG. 2B illustrates a method for calculating a light profile depending on a distance between a light source and a pixel of an analysis area to be analyzed when a dimming value is 60%.

FIG. 1 illustrates a light profile at a dimming value of 100% and a light profile at a dimming value of 60%. FIG. 2A illustrates a method for calculating a light profile depending on a distance between a light source and a pixel of an analysis area to be analyzed when a dimming value is 100%. FIG. 2B illustrates a method for calculating a light profile depending on a distance between the light source and a pixel of an analysis area to be analyzed when a dimming value is 60%.

As shown in FIGS. 1 and 2, supposing that arbitrary one pixel is affected by light of a 5×5 analysis area BL5×5 including 25 blocks. The arbitrary one pixel is positioned in center block of the 25 blocks. The light of the 25 blocks is reached to the arbitrary one pixel. In this case, a total amount of light reaching the one pixel may be calculated by adding dimming values of the 25 blocks. Further, supposing that only light sources in the 5×5 analysis area BL5×5 have been turned on, an amount of light reaching the one pixel may be calculated based on a previously measured light profile, the dimming values of the 25 blocks, and a distance between the one pixel and the light source. An amount of light reaching the one pixel is calculated by a sum of an amount of light coming from each of the 25 blocks.

Figure 3:
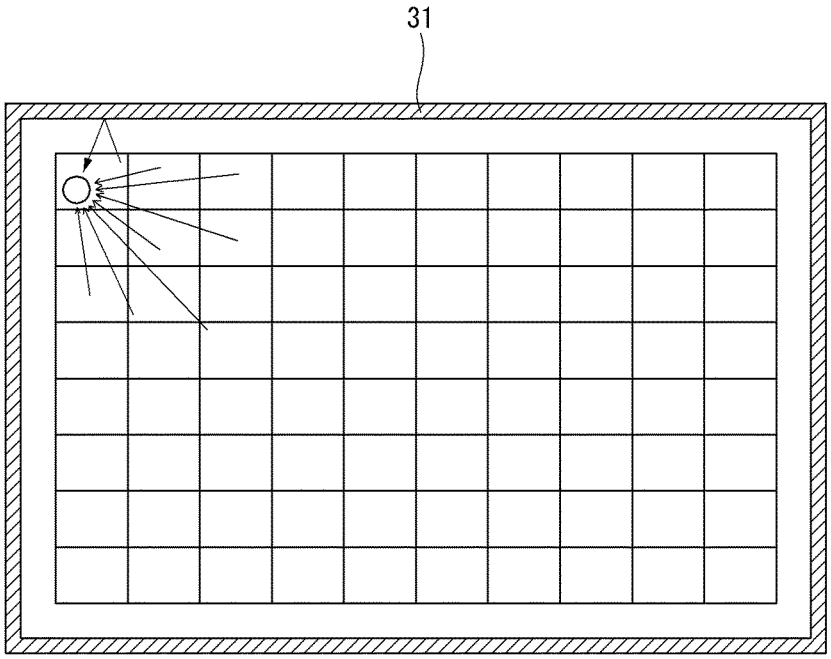
FIG. 3 illustrates light reaching a pixel of a corner portion of a liquid crystal display panel.

As shown in FIG. 3, when an amount of light of a corresponding pixel existing in a side portion or a corner portion of a liquid crystal display panel is calculated, a portion of a 5×5 analysis area adjacent to the corresponding pixel may be excluded from the liquid crystal display panel. In this case, an amount of light of a block including the corresponding pixel greatly may decrease. However, in fact, because a portion of light reaching the corresponding pixel of the side portion or the corner portion is reflected from a reflective object 31 and again returns to the corresponding pixel, a really measured amount of light of the corresponding pixel is greater than a calculation amount of light of the corresponding pixel. Accordingly, the calculation amount of light of the corresponding pixel in the side portion or the corner portion of the liquid crystal display panel where the portion of the 5×5 analysis area is excluded is greatly different from the really measured amount of light of the corresponding pixel. For example, an error degree of a calculation amount of light of the corresponding pixel in the corner portion is approximately three times an error degree of a calculation amount of light of the corresponding pixel in a middle portion of the liquid crystal display panel. Further, an error degree of a calculation amount of light of the corresponding pixel in the side portion is approximately two times the error degree of the calculation amount of light of the corresponding pixel in the middle portion.

Figure 4A:
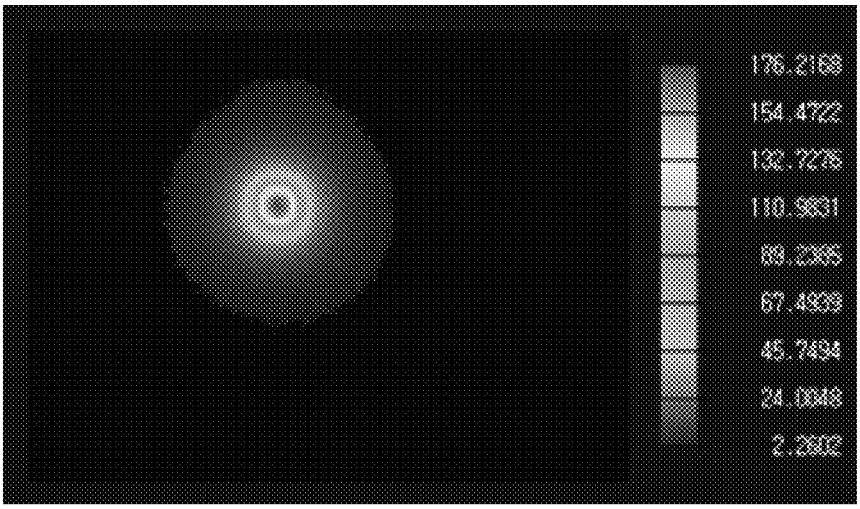
FIGS. 4A to 4C are simulation images illustrating the result of a calculation of a light profile in a middle portion, a side portion, and a corner portion of a liquid crystal display panel.
Figure 4B:
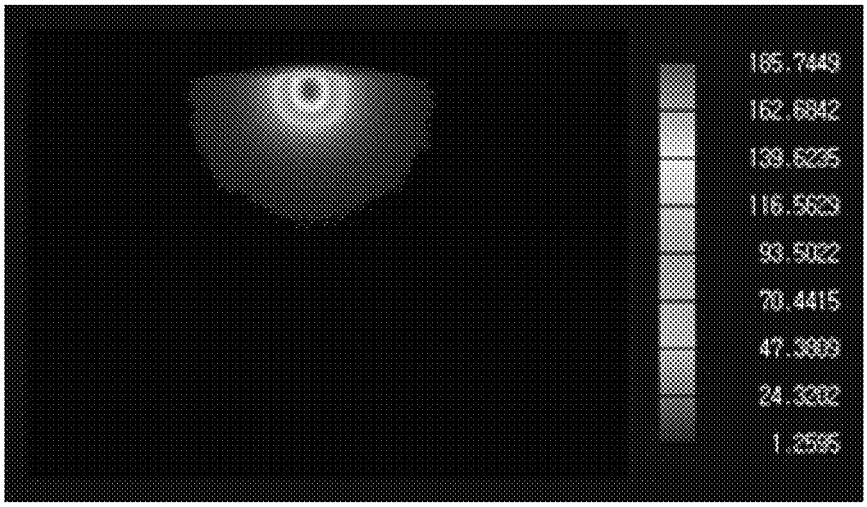
Figure 4C:
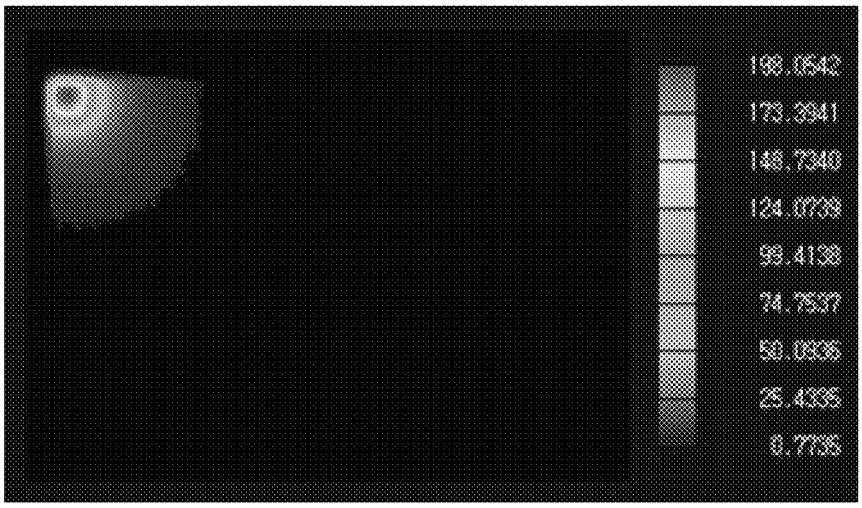
Figure 6:
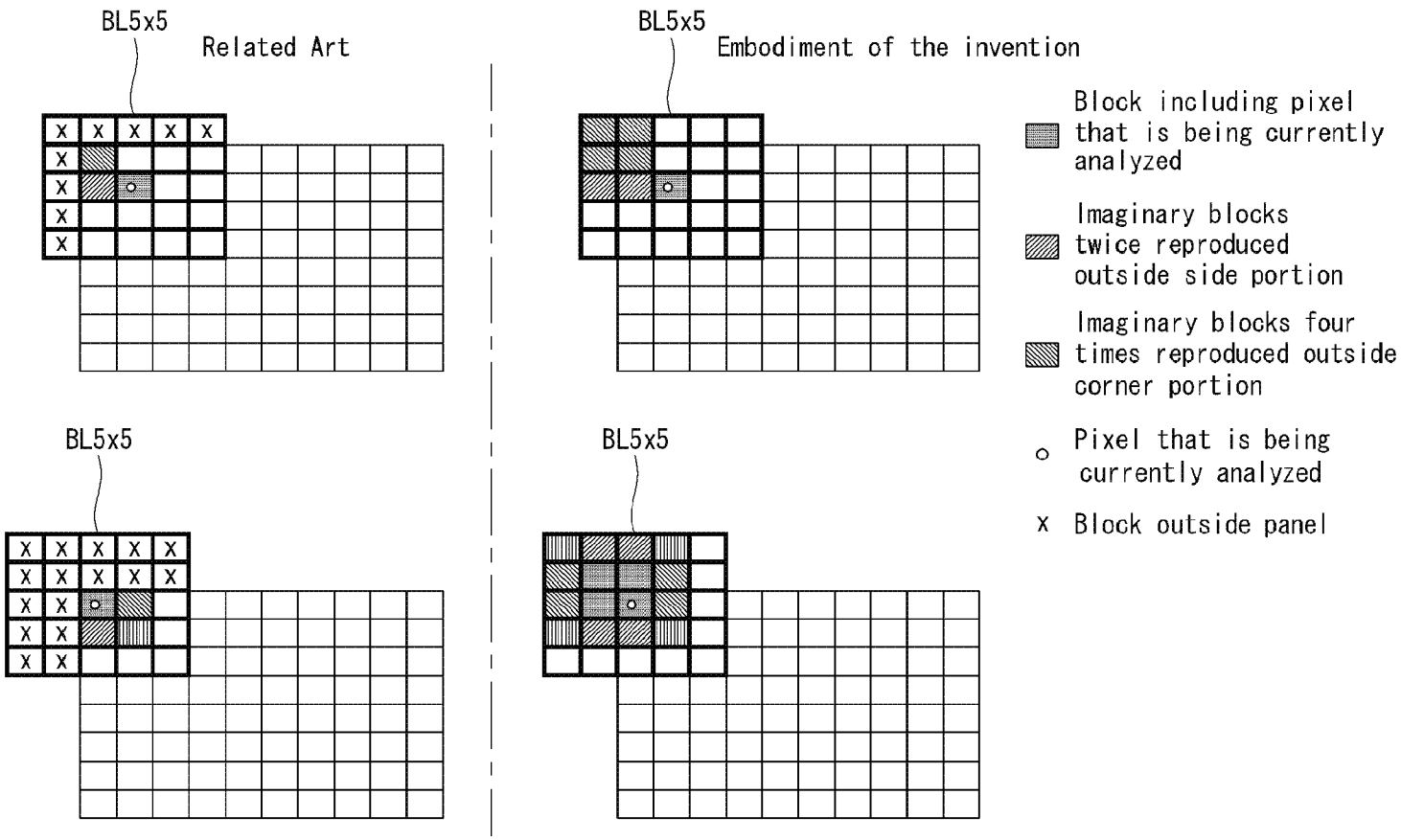
FIG. 6 illustrates a related art and an exemplary embodiment of the invention of a mapping example between a screen and an analysis area in a side portion and a corner portion of a liquid crystal display panel.

FIGS. 4A to 4C are simulation images illustrating the result of a calculation of a light profile in a middle portion, a side portion, and a corner portion of the liquid crystal display panel. FIGS. 5 and 6 illustrate a method for compensating for pixel data according to an exemplary embodiment of the invention.

As shown in FIGS. 5 and 6, the method for compensating for pixel data according to the exemplary embodiment of the invention includes dividing a virtual screen greater than a real screen into a plurality of light amount analysis areas with the predetermined size and calculating an amount of light of each of pixels on the real screen. The virtual screen includes the real screen and a virtual portion.

A side portion and a corner portion of the real screen extend to form the virtual portion of the virtual screen. The virtual portion includes virtual pixels each having a dimming value in which dimming values of pixels in the side portion and the corner portion of the real screen are reproduced in a mirror-symmetrical manner. In FIG. 5, a numeral indicates a dimming value. An amount of light of each pixel is calculated by setting the dimming values of the virtual portion to be mirror-symmetrical to the dimming values of the real screen and adding the dimming values of the light amount analysis area using the same method as an existing method for calculating the light profile. In the light amount calculation method, because the analysis areas in the side portion and the corner portion of the liquid crystal display panel are not excluded from the liquid crystal display panel, an amount of light of a pixel at any position of the liquid crystal display panel can be exactly calculated.

For example, if the size of the real screen is 10×8 and the size of the light amount analysis area is 5×5, the size of the virtual screen may be set to 14×12. As shown in FIG. 6, an amount of light of a corresponding pixel in the side portion and the corner portion of the liquid crystal display panel is calculated based on the 5×5 analysis area in the same manner as the light amount calculation performed in the middle portion of the liquid crystal display panel because the 5×5 analysis area around the corresponding pixel exists in the liquid crystal display panel.

The method for calculating the light amount of the pixel on the virtual screen is substantially the same as the existing calculation method. Namely, supposing that only the light sources providing light to only the 5×5 analysis area have been turned on, an amount of light of a pixel that is being currently analyzed may be calculated by mapping the 5×5 analysis area to the virtual screen and by adding the dimming values of the 25 blocks of the 5×5 analysis area.

As another example of the virtual screen, if the size of the real screen is 16×10 and the size of the light amount analysis area is 7×7, the size of the virtual screen may be set to 22×16.

Figure 7:
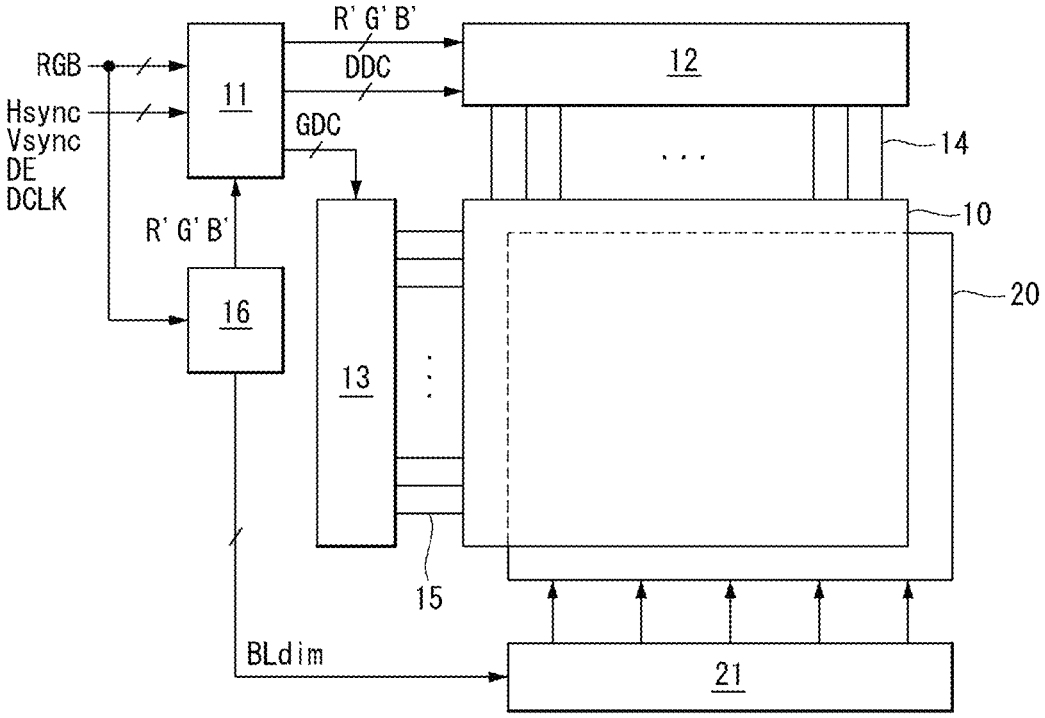
FIG. 7 is a block diagram of a liquid crystal display according to an exemplary embodiment of the invention.
Figure 8:
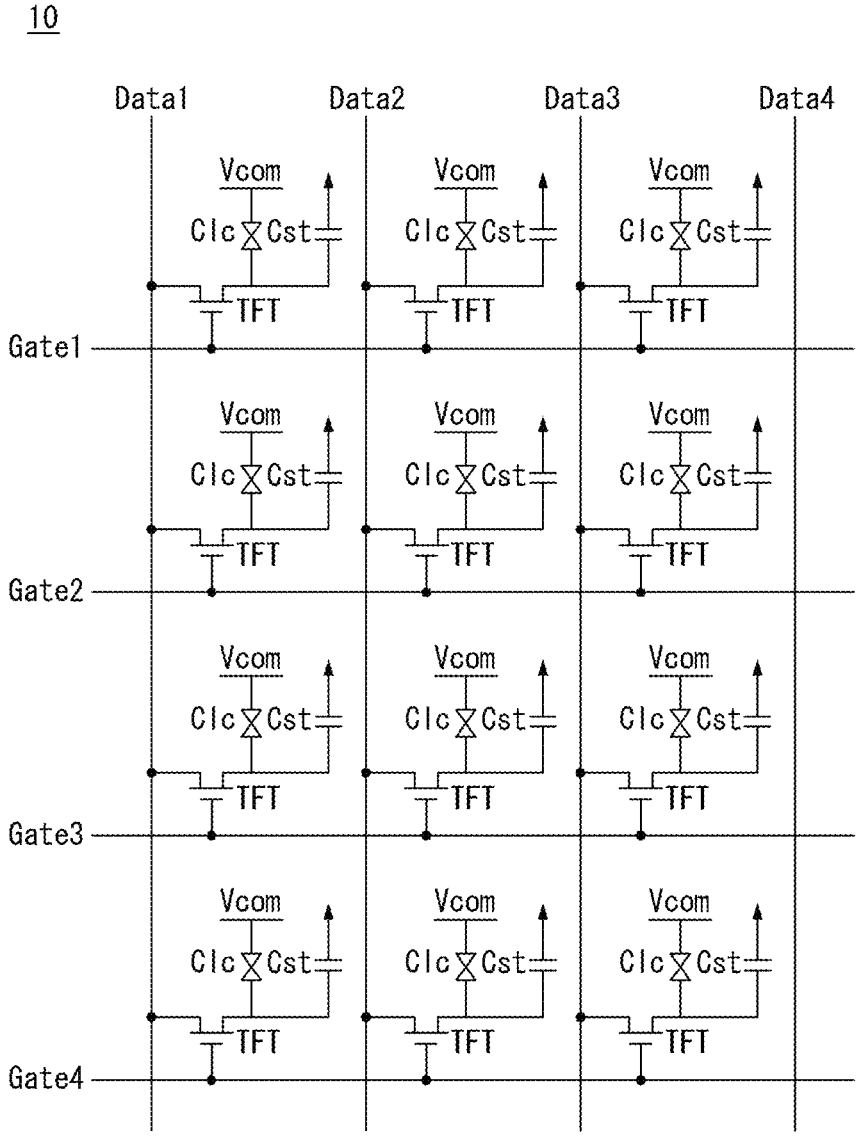
FIG. 8 is an equivalent circuit diagram of a portion of a pixel array of a liquid crystal display panel shown in FIG. 7.
Figure 9:
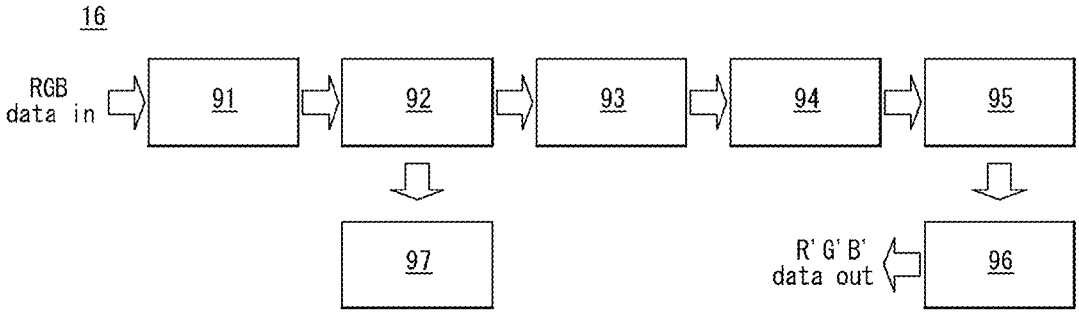
FIG. 9 is a block diagram showing in detail a local dimming controller shown in FIG. 7.

FIGS. 7 to 9 illustrate a liquid crystal display according to the exemplary embodiment of the invention.

As shown in FIGS. 7 to 9, a liquid crystal display according to the exemplary embodiment of the invention includes a liquid crystal display panel 10, a source driver 12 for driving data lines 14 of the liquid crystal display panel 10, a gate driver 13 for driving gate lines 15 of the liquid crystal display panel 10, a timing controller 11 for controlling the source driver 12 and the gate driver 13, a backlight unit 20 providing light to the liquid crystal display panel 10, a light source driver 21 for driving light sources of the backlight unit 20, and a local dimming controller 16 for controlling local dimming.

The liquid crystal display panel 10 includes an upper glass substrate, a lower glass substrate, and a liquid crystal layer between the upper and lower glass substrates. The plurality of data lines 14 and the plurality of gate lines 15 cross one another on the lower glass substrate of the liquid crystal display panel 10. As shown in FIG. 8, a plurality of liquid crystal cells Clc are arranged on the liquid crystal display panel 10 in a matrix form in accordance with a crossing structure of the data lines 14 and the gate lines 15. The data lines 14, the gate lines 15, thin film transistors TFT, pixel electrodes of the liquid crystal cells Clc connected to the thin film transistors TFT, storage capacitors Cst, and the like are formed on the lower glass substrate of the liquid crystal display panel 10.

A black matrix, a color filter, and a common electrode are formed on the upper glass substrate of the liquid crystal display panel 10. In a vertical electric field drive manner such as a twisted nematic (TN) mode and a vertical alignment (VA) mode, the common electrode is formed on the upper glass substrate. In a horizontal electric field drive manner such as an in-plane switching (IPS) mode and a fringe field switching (FFS) mode, the common electrode and the pixel electrode are formed on the lower glass substrate. Polarizing plates are respectively attached to the upper and lower glass substrates of the liquid crystal display panel 10. Alignment layers for setting a pre-tilt angle of liquid crystals are respectively formed on the inner surfaces contacting the liquid crystals in the upper and lower glass substrates.

A pixel array of the liquid crystal display panel 10 and a light emitting surface of the backlight unit 20 opposite the pixel array are divided into a plurality of blocks for local diming. Each of the blocks includes i×j pixels, where i and j are a positive integer equal to or greater than 2, and a backlight light emitting surface providing light to the ixj pixels. Each pixel includes subpixels of three primary colors, and each subpixel includes one liquid crystal cell Clc.

The timing controller 11 receives timing signals Vsync, Hsync, DE, and DCLK from an external system board and supplies digital video data RGB to the source driver 12. The timing signals Vsync, Hsync, DE, and DCLK include a vertical sync signal Vsync, a horizontal sync signal Hsync, a data enable signal DE, and a dot clock DCLK. The timing controller 11 generates a source timing control signal DDC and a gate timing control signal GDC for respectively controlling operation timings of the source driver 12 and the gate driver 13 based on the timing signals Vsync, Hsync, DE, and DCLK received from the external system board. The external system board or the timing controller 11 inserts an interpolation frame between frames of an input video signal input at a frame frequency of 60 Hz and multiplies the frequency of the source timing control signal DDC by the frequency of the gate timing control signal GDC. Hence, the timing controller 11 can control operations of the source driver 12 and the gate driver 13 at a frame frequency of (60×N) Hz, where N is a positive integer equal to or greater than 2.

The timing controller 11 supplies the digital video data RGB of an input image received from the external system board to the local dimming controller 16 and supplies digital video data R'G'B' modulated by the local dimming controller 16 to the source driver 12.

The source driver 12 latches the digital video data R'G'B' under the control of the timing controller 11. The source driver 12 converts the digital video data R'G'B' into positive and negative analog data voltages using positive and negative gamma compensation voltages and supplies the positive/negative analog data voltages to the data lines 14.

The gate driver 13 includes a shift register, a level shifter for converting an output signal of the shift register into a swing width suitable for a TFT drive of the liquid crystal cells, an output buffer, and the like. The gate driver 13 includes a plurality of gate driver integrated circuits (ICs). Each of the plurality of gate driver ICs sequentially outputs a gate pulse (or a scan pulse) having a pulse width of about one horizontal period and sequentially supplies the gate pulse to the gate lines 15 in synchronization with the data voltage supplied to the data lines 14.

The backlight unit 20 is positioned under the liquid crystal display panel 10 and includes a plurality of light sources. The plurality of light sources are divided into a plurality of blocks, and the plurality of blocks each the light sources are individually controlled by the light source driver 21. Hence, the backlight unit 20 can uniformly provide light to the liquid crystal display panel 10. The backlight unit 20 may be one of an edge type backlight unit and a direct type backlight unit. The light sources of the backlight unit 20 may include one or two of a hot cathode fluorescent lamp (HCFL), a cold cathode fluorescent lamp (CCFL), an external electrode fluorescent lamp (EEFL), and a light emitting diode (LED).

The light source driver 21 individually controls the plurality of blocks each including the light sources using a pulse width modulation (PWM) signal whose a duty ratio (unit:%) varies depending on a dimming value BLdim received from the local dimming controller 16. The PWM signal controls turn-on and turn-off percentages of the light sources, and the duty ratio of the PWM signal is determined based on the dimming value BLdim received from the local dimming controller 16.

The local dimming controller 16 analyzes the digital video data RGB of each block received from the timing controller 11 and calculates a representative value of each block. The representative value of each block may be calculated by an average value of the input image or an average picture level (APL). The average value of the input image is an average value of maximum values among R, G, and B values in each pixel. The APL is an average value of luminance values of the pixels. The local dimming controller 16 maps the representative value of each block to a previously set dimming curve to output the dimming value BLdim of each block of the backlight unit 20. The local dimming controller 16 modulates the digital video data RGB received from the timing controller 11 and compensates for pixel data to be displayed on the liquid crystal display panel 10. The local dimming controller 16 codes the dimming value BLdim of each block to data of serial peripheral interface (SPI) format and supplies the coded data to a micro control unit (MCU) of the light source driver 21.

FIG. 9 is a block diagram showing in detail the local dimming controller 16. As shown in FIG. 9, the local dimming controller 16 includes a representative value calculating unit 91, a local dimming value selecting unit 92, a block selecting unit 93, a light amount analyzing unit 94, a gain calculating unit 95, a data compensation unit 96, and a light source controller 97.

The representative value calculating unit 91 divides data of an input image into a plurality of blocks and calculates a representative value of each of the plurality of blocks.

The local dimming value selecting unit 92 maps the representative value of each block to a previously set dimming curve and selects a dimming value BLdim of each block. The local dimming value selecting unit 92 outputs the dimming value BLdim of each block to the block selecting unit 93 and the light source controller 97. The local dimming value selecting unit 92 may select the dimming value BLdim of each block using a lookup table. The lookup table receives the representative value of each block and selects the dimming value BLdim of each block mapped to the representative value of each block from the previously set dimming curve.

The block selecting unit 93 selects an analysis area of 5×5 size (or 7×7 size) using the dimming value BLdim of each block received from the local dimming value selecting unit 92. The light amount analyzing unit 94 calculates a total amount of light of each pixel using dimming values of blocks belonging to the selected analysis area.

The gain calculating unit 95 calculates a gain of each pixel. The gain is calculated by a ratio of an amount of light of a pixel in non-local dimming (i.e., when all of the light sources of the backlight unit 20 are turned on in a full-white pattern or at a maximum brightness) to an amount of light of the pixel calculated through the light profile in local dimming Namely, the gain G may be calculated to be $G=K_{normal}/K_{local}$. In the above equation, $K_{normal}$ is a constant indicating a backlight luminance when the local dimming is not performed and is a constant indicating the luminance of the full-white pattern. $K_{local}$ is a variable indicating an amount of light of a specific pixel based on the dimming value BLdim of each block when the local dimming is performed. The data compensation unit 96 multiplies the gain value by original pixel data to modulate data, thereby compensating for pixel data.

The light source controller 97 codes the dimming value BLdim of each block received from the local dimming value selecting unit 92 to data of the SPI format and supplies the coded data to the light source driver 21.

As another exemplary embodiment of the invention, an amount of light of each pixel on the real screen is calculated using the same manner as the existing method without setting the virtual screen. The calculation method according to another exemplary embodiment of the invention has an error in the side portion and the corner portion of the liquid crystal display panel. In this case, the data compensation unit 96 adds or multiplies a gain for compensation of pixel data in the side portion and the corner portion of the liquid crystal display panel to or by a predetermined weight value, modulates the gain of the pixel data to be greater than a gain of a pixel existing in the middle portion of the liquid crystal display panel, and multiplies the modulated gain by the pixel data of the side portion and the corner portion of the liquid crystal display panel. Hence, the data compensation unit 96 compensates for the pixel data in the side portion and the corner portion of the liquid crystal display panel. The calculation method may be applied along with the method for calculating the light profile based on the virtual screen.

As described above, the exemplary embodiments of the invention extends the side portion and the corner portion of the real screen to set the virtual screen or increases the gain of the side portion and the corner portion of the liquid crystal display panel, thereby minimizing an error in the amount of light of the pixel in the side portion and the corner portion of the liquid crystal display panel.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A method of compensating for pixel data comprising:

extending a side portion and a corner portion of a real screen to set an virtual screen;

setting dimming values of the virtual screen using dimming values of the real screen;

calculating an amount of light of each of pixels on the side portion and the corner portion of the real screen by adding dimming values of blocks belonging to a predetermined analysis area including the real screen and the virtual screen; and multiplying the amount of light of each pixel by a gain of each pixel to modulate pixel data, wherein a size of the virtual screen is based on a size of the predetermined analysis area.

2. The method of claim 1, wherein the setting of the dimming values of the virtual screen comprises reproducing the dimming values of the real screen in a side portion and a corner portion of the virtual screen in a mirror-symmetrical manner.

3. The method of claim 1, wherein a width and a height of the size of the virtual screen is greater than a width and a height of the size of the real screen by approximately a width and a height of the size of the predetermined analysis area.

4. A liquid crystal display comprising:

a liquid crystal display panel;

a backlight unit configured to provide light to the liquid crystal display panel;

a light source driver configured to drive light sources of the backlight unit;

a local dimming controller configured to divide the liquid crystal display panel into a plurality of blocks, calculate a dimming value of each block, control the light source driver using the dimming value of each block, and modulate pixel data of the liquid crystal display panel, wherein the local dimming controller extends a side portion and a corner portion of a real screen to set an virtual screen, sets dimming values of the virtual screen using dimming values of the real screen, calculates an amount of light of each of pixels on the side portion and the corner portion of the real screen by adding dimming values of blocks belonging to a predetermined analysis area including the real screen and the virtual screen, and multiplies the amount of light of each pixel by a gain of each pixel to modulate pixel data, wherein a size of the virtual screen is based on a size of the predetermined analysis area.

5. The liquid crystal display of claim 4, wherein the local dimming controller reproduces the dimming values of the real screen in a side portion and a corner portion of the virtual screen in a mirror-symmetrical manner.

6. The liquid crystal display of claim 4, wherein a width and a height of the size of the virtual screen is greater than a width and a height of the size of the real screen by approximately a width and a height of the size of the predetermined analysis area.

* * * * *